US012765594B2

(12) United States Patent
Xiao et al.

(10) Patent No.: US 12,765,594 B2
(45) **Date of Patent: *Oct. 20, 2026**

(54) MODULE FOR AN AEROSOL PROVISION DEVICE

(71) Applicant: Nicoventures Trading Limited, London (GB)

(72) Inventors: Zhihuang Xiao, London (GB); Tomi Vintola, London (GB)

(73) Assignee: Nicoventures Trading Limited, London (GB)

( * ) Notice: Subject to any disclaimer, the term of this patent is extended or adjusted under 35 U.S.C. 154(b) by 637 days.

This patent is subject to a terminal disclaimer.

(21) Appl. No.: 18/245,482

(22) PCT Filed: Sep. 15, 2021

(86) PCT No.: PCT/GB2021/052393

§ 371 (c)(1),
(2) Date: Mar. 15, 2023

(87) PCT Pub. No.: WO2022/058727

PCT Pub. Date: Mar. 24, 2022

(65) Prior Publication Data

US 2024/0023606 A1 Jan. 25, 2024

(30) Foreign Application Priority Data

Sep. 15, 2020 (GB) ..... 2014516

(51) Int. Cl.
*A24F 40/40* (2020.01)
*A24F 40/53* (2020.01)
(Continued)

(52) U.S. Cl.
CPC ..... *A24F 40/40* (2020.01); *A24F 40/53* (2020.01); *A24F 40/65* (2020.01); *A24F 40/90* (2020.01)

(58) Field of Classification Search
None
See application file for complete search history.

(56) References Cited

U.S. PATENT DOCUMENTS

2015/0114408 A1* 4/2015 Lord ..... A24F 40/53 131/329
2015/0333561 A1 11/2015 Alarcon
(Continued)

FOREIGN PATENT DOCUMENTS

KR 20170041680 A 4/2017
WO 2014/144802 A1 9/2014
(Continued)

OTHER PUBLICATIONS

Office action from corresponding UA Application No. a 2023 01644, mailed Apr. 21, 2025, all pages cited in its entirety.
(Continued)

*Primary Examiner* — Cynthia Szewczyk
(74) *Attorney, Agent, or Firm* — Burr & Forman

(57) ABSTRACT

A module for use with an aerosol provision device is described, the module including a housing and one or more connectors configured to interact with an aerosol provision device or another module. In use, the module is configured to be operatively connected by means of the one or more connectors to the aerosol provision device, either directly or via one or more further modules. The module can include one or more components configured to provide the operatively connected aerosol provision device with additional functionality, in use. There is also provided an aerosol provision device and a system.

18 Claims, 7 Drawing Sheets

(51) Int. Cl.
*A24F 40/65* (2020.01)
*A24F 40/90* (2020.01)

(56) References Cited

U.S. PATENT DOCUMENTS

| | | | | |
|---|---|---|---|---|
| 2016/0331035 | A1 | 11/2016 | Cameron | |
| 2017/0093981 | A1 | 3/2017 | Cameron | |
| 2018/0110262 | A1 | 4/2018 | Batista et al. | |
| 2018/0117268 | A1* | 5/2018 | Selby | A61M 15/06 |

FOREIGN PATENT DOCUMENTS

| | | | |
|---|---|---|---|
| WO | 2016/023809 | A1 | 2/2016 |
| WO | 2019/086972 | A1 | 5/2019 |

OTHER PUBLICATIONS

International Search Report and Written Opinion received for PCT Patent Application No. PCT/GB2021/052393, mailed on Jan. 4, 2022, 13 Pages.
Notice to File a Response from corresponding Korean Application No. 10-2023-7012796, mailed Jul. 7, 2025, all pages cited in its entirety.

* cited by examiner

MODULE FOR AN AEROSOL PROVISION DEVICE

PRIORITY CLAIM

The present application is a National Phase entry of PCT Application No. PCT/GB2021/052393, filed Sep. 15, 2021, which claims priority from GB Application No. 2014516.5, filed Sep. 15, 2020, each of which hereby fully incorporated herein by reference.

TECHNICAL FIELD

The present disclosure relates to a module for use with an aerosol provision device and a system comprising an aerosol provision device and one or more modules.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine.

SUMMARY

According to a first aspect of the present disclosure, there is provided a module for use with an aerosol provision device, the module comprising: a housing; and one or more connectors configured to interact with an aerosol provision device or another module; wherein, in use, the module is configured to be operatively connected by means of the one or more connectors to the aerosol provision device, either directly or via one or more further modules; and wherein the module further comprises one or more components configured to provide the operatively connected aerosol provision device with additional functionality, in use.

According to a second aspect of the present disclosure, there is provided an aerosol provision device comprising: a housing; an aerosol generator located within the housing; a power supply located within the housing; and one or more connectors, each configured to interact with a module; wherein when one or more modules is operatively connected to the aerosol provision device, the operatively connected one or more modules provides the aerosol provision device with additional functionality, in use.

According to a third aspect of the present disclosure, there is provided a system comprising an aerosol provision device and one or more modules, wherein the one or more modules is operatively connected to the aerosol provision device; the operative connection being either: a direct connection to the aerosol provision device; or a connection to one or more other modules, wherein at least one of the one or more other modules is directly connected to the aerosol provision device, wherein the operatively connected one or more modules provides the aerosol provision device with additional functionality.

Further features and advantages of the disclosure will become apparent from the following description of various embodiments of the disclosure, given by way of example only, which is made with reference to the accompanying drawings.

DETAILED DESCRIPTION

Figure 1:
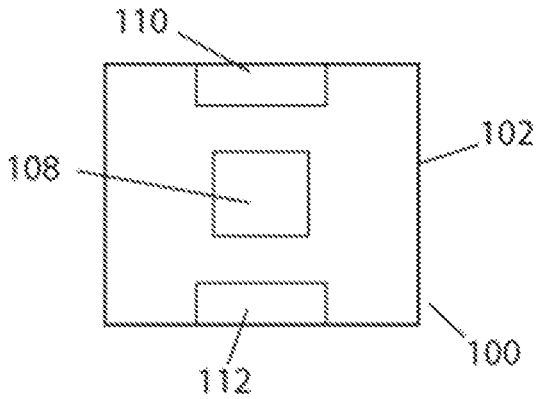
FIG. 1 shows a schematic view of an example of a module.

As used herein, the term "aerosol-generating material" includes materials that provide volatilized components upon heating, typically in the form of an aerosol. Aerosol-generating material includes any tobacco-containing material and may, for example, include one or more of tobacco, tobacco derivatives, expanded tobacco, reconstituted tobacco or tobacco substitutes. Aerosol-generating material also may include other, non-tobacco, products, which, depending on the product, may or may not contain nicotine. Aerosol-generating material may for example be in the form of a solid, a liquid, a gel, a wax or the like. Aerosol-generating material may for example also be a combination or a blend of materials. Aerosol-generating material may also be known as "smokable material".

Apparatus is known that heats aerosol-generating material to volatilize at least one component of the aerosol-generating material, typically to form an aerosol which can be inhaled, without burning or combusting the aerosol-generating material. Such apparatus is sometimes described as an "aerosol provision device", an "aerosol-generating device", a "heat-not-burn device", a "tobacco heating product device" or a "tobacco heating device" or similar. Similarly, there are also so-called e-cigarette devices, which typically vaporize an aerosol-generating material in the form of a liquid, which may or may not contain nicotine. The aerosol-generating material may be in the form of or be provided as part of a rod, cartridge or cassette or the like which can be inserted into the apparatus. A heater for heating and volatilizing the aerosol-generating material may be provided as a "permanent" part of the apparatus, or could be combined with the aerosol-generating material in a replaceable or consumable component.

An aerosol provision device can receive an article comprising aerosol-generating material for heating. An "article" in this context is a component that includes or contains, in use, the aerosol-generating material, which is heated to volatilize the aerosol-generating material, and optionally other components in use. A user may insert the article into the aerosol provision device before it is heated to produce an aerosol, which the user subsequently inhales. The article may be, for example, of a predetermined or specific size that is configured to be placed within a heating chamber of the device which is sized to receive the article. Alternatively, aerosol-generating material can simply be located in a free or unconstrained manner in a heating chamber or aerosol-generation area of a device; loose leaf tobacco, for example, could be used in this way.

As used herein, the term "operative connection" is a connection through which power and/or data may be transmitted from a module to another module and/or to an aerosol provision device. A module that is "operatively connected" to an aerosol provision device may be connected directly to the aerosol provision device, or may be directly connected to one or more other modules if at least one of the one or more other modules is directly connected to the aerosol provision device. In such an arrangement, all of the connected modules are considered to be "operatively connected" to the aerosol provision device.

As used herein, when referring to a module, the term "in use" is when the module is operatively connected to an aerosol provision device. It is not required that the aerosol provision device is also in use by a user for the purpose of generating an aerosol for inhalation for it to be considered to be operatively connected; however, this may also be the case.

As used herein, the term "controller" is intended to mean any means by which the function of a device may be controlled. For example, a controller may comprise a simple switch configured to activate and deactivate the supply of electrical power from a power supply. Alternatively, a controller may comprise one or more microchips, which may be configured to control complex functionality in a device. A controller may be configured to allow a user direct control of the device or may be configured to control the function of a device automatically, such as in response to a user's puff, for example, or a combination thereof. Remote control of the device is also envisaged.

As used herein, the term "external device" refers to any device that is not an aerosol provision device or a module according to the present disclosure.

In order to improve user experience in the use of an aerosol provision device, there is a continual drive to improve the functionality of the device. Such increased functionality may be, for example, a larger battery size, improved means for user interaction, increased connectivity and data management, etc. However, adding additional functionality to an aerosol provision device generally results in an increase in at least one of: the size, weight and cost of the device. Furthermore, some users may desire improvements in only some of the possible functionality. For example, some users may desire an increased battery size, but may not be interested in more elaborate user interface options. In order to attempt to satisfy the demands of a wide potential user base, suppliers of aerosol provision devices would need to offer a broad range of devices comprising many possible combinations of increased functionality.

The present disclosure addresses this problem by moving all but the most basic functionality of the aerosol provision device into removable add-on modules. The aerosol provision device is configured to function independently of any modules, but the functionality is kept to a bare minimum. This allows for the basic aerosol provision device to be small, light and inexpensive. A user may then obtain one or more modules to attach to the aerosol provision device in whatever combination desired, in order to add desired functionality. For example, a user desiring an increased battery life may chose an add-on module containing a larger battery. Such a module, as described in more detail below, would allow for the internal power supply of the aerosol provision device to be recharged while on the move or even in use. Furthermore, such an additional power supply module could act to augment the power supplied to the aerosol generator of the aerosol provision device allowing for the aerosol provision device to operate in a higher power mode. A further example of a module, again as discussed in more detail below, could be to add communication functionality to a device. Such a module could, for example, allow for usage data recorded by the device to be communicated to cloud data storage for processing and analysis. The additional communication functionality may be something a user only requires infrequently, for example once per day or once per week. In such circumstances, the communications module could be temporarily added to the device to allow for data to be transferred from the device. Such a module would allow for additional communications functionality to be selectively added to the aerosol provision device when needed, without the additional size and weight of the components being permanently added to the device.

A user may wish to add the additional functionality of multiple add-on modules to an aerosol provision device simultaneously. For example, a user may wish to adjust the way in which the aerosol provision device operates while using the device in a higher power heating mode; in order to achieve this, the user could connect to the aerosol provision device a module configured to supply additional power, and a module configured to provide an enhanced user interface. In such an arrangement, an add-on power module would provide the aerosol provision device with additional power in order for the aerosol generator to operate in a higher power mode, and an add-on user interface module would provide an enhanced user interface through which the user could adjust the configuration and/or operation of the aerosol provision device. This could allow the user, for example, to make changes to the configuration while using the device in a high-power mode; neither functionality would be possible without the relevant modules being operatively connected to the base aerosol provision device. In this example, once the user is satisfied with the configuration, the user interface module could then be detached allowing the device to operate in the configured mode, while still receiving additional power from the attached power supply module. It should be appreciated that this particular configuration of a power supply module and a user interface module is just one of many possible combinations of two or more modules that a user may choose to use in order to add the functionality of multiple add-on modules to an aerosol provision device.

It is also understood that the components of an aerosol provision device that are most likely to become fatigued through use are the aerosol generator, for example a heater, and the battery. A further advantage of the present disclosure, therefore, is that a user can easily and inexpensively replace the aerosol provision device should such components become degraded through use. This is in contrast to more complex devices, where fatigue to these components would require either repair of the components or the purchase of a new device, each of which would likely be costly and inconvenient to the user. This is also the case for any physical damage that could befall the aerosol provision device in everyday use; the aerosol provision device can be easily and inexpensively replaced without needing to replace the additional components needed for enhanced functionality (i.e. the add-on modules).

A first aspect of the present disclosure defines a module for use with an aerosol provision device. The module comprises a housing and at least one connector configured to connect with an aerosol provision device or another module. The connector is configured in any way that allows for an operative connection to be formed between the module and at least one of: another module and an aerosol provision device. The connector could be a generic connector, such as a USB Type C connector, or the connector could comprise a proprietary design.

Forming an operative connection may involve a physical engagement between the connector of the module and a connector of either another module or an aerosol provision device. Such a physical connection may be achieved by the module comprising one or both of a male or female portion of a connector such as a USB Type C connector. Alternatively, the physical engagement may be achieved through a genderless connection. A physical connection has the advantage of improved reliability, and simple design. It additionally provides an opportunity for tactile feedback for users, in that a user can feel and/or see when a physical connection has been made between the module(s) and the aerosol provision device or additional module.

The connector may also be configured such that physical engagement is not necessary. An operative connection could be achieved, for example, through the use of a wireless data and/or power connection. The module may additionally be secured to another module and/or an aerosol provision device using, for example, magnetic attraction. Non-physical connections have the advantage that external connectors can be avoided, reducing the risk of damage to the connectors during the lifetime of the components and simplifying the design of the housing for both the module and the aerosol provision device/additional module. Whilst the additional securing of the module to another module and/or an aerosol provision device is not essential, it can assist in ensuring that the non-physical operable connection between the relevant components is reliable due to the retention of contact between the module and the relevant component.

A further alternative could be to use a physical engagement to secure the devices together, while the operative connection (i.e. the data and/or power connection) is achieved wirelessly. Such a physical engagement could be achieved, for example, by an interference fit between components, or through external engagement members. A physical engagement has the advantage that the user can more easily determine whether a connection has been made between the components, for example, through a tactile signal or simply by being able to visually perceive or feel that the connection has been made. A wireless operative connection avoids using power and/or data connections on the housing of components, thus simplifying the design and manufacturing requirements of the housing.

According to the first aspect of the present disclosure, the module is configured such that, in use, the module is operatively connected to an aerosol provision device, either directly or via one or more further modules. The module further comprises one or more components configured to provide the operatively connected aerosol provision device with additional functionality. This has the advantage of allowing the aerosol provision device to be simple, small, lightweight and inexpensive, while allowing for additional functionality to be added to the device when desired by operatively connecting one or more modules.

In one example, the module further comprises one or more controllers, each controller being configured to control at least one aspect of the functionality of the module. A controller may comprise a simple switch, for example a switch configured to activate and deactivate the supply of electrical power from a power supply. Alternatively, a controller may comprise one or more microchips, which may be configured to control complex functionality in the module. A controller may be configured to allow a user direct control of the module, or of one or more operatively connected devices. Alternatively, a controller may be configured to control the function of the module, or one or more operatively connected devices, automatically, such as in response to a user's puff, for example, or a combination thereof. Remote control of the device is also envisaged. Including one or more controllers has the advantage of increasing the functionality of the module.

In another example, the module comprises an internal power supply located within the housing of the module. The internal power supply may be, for example, a rechargeable battery, such as a lithium-ion battery or a nickel-cadmium battery, or a capacitor. An internal power supply could, for example, allow the module to have some functionality when not connected to an aerosol provision device, such as indicating to a user the charge level of the internal power supply.

A primary function of a module with an internal power supply, however, is to supply additional power to the aerosol provision device, in use, by charging the internal power supply of the aerosol provision device. This allows the aerosol provision device to operate for an extended period of time, without the need for a larger internal power supply. The charging of the internal power supply of the aerosol provision device by the module can optionally take place while the aerosol provision device is also in use by a user. The additional power provided by the module to the aerosol provision device may allow for the aerosol generator of the aerosol provision device to operate at a higher power and/or temperature than in normal use. The use of increased power may be referred to as a "boost mode". The activation of a boost mode when a module comprising an internal power supply is operatively connected to the aerosol provision device could be automatic or it could be activated by further user interaction. The choice of automatic activation, or of the requirement for further user input, may be a pre-set selection that is learned by and/or stored in the module, in another module and/or in the aerosol provision device. The module may also be configured to identify an operatively attached device (either an aerosol provision device, or one or more other modules), and to determine the electrical power requirement of the operatively attached device. The identification of the operatively attached device may be automatic or may be as a result of data communication between the module and the operatively attached device. The module may be configured to automatically provide an appropriate amount of electrical power to the operatively attached device, according to the identified electrical power requirement of the operatively attached device. This is advantageous, as it would allow for a module containing an internal power supply to provide electrical power to a wide range of possible aerosol provision devices and/or modules.

In another example of a module with an internal power supply, the module contains means for wireless transmission of electrical power. This may comprise means for receiving electrical power from an external supply, such as from an external wireless charging pad. Alternatively, or in addition, the means for wireless power transmission may be configured to transmit electrical power to a further device, external to the housing of the module. The further device may be another module, an aerosol provision device or an external device configured to receive electrical power wirelessly. The module may comprise more than one means for wireless transmission of electrical power, such that the module may transfer electrical power to or from more than one device simultaneously. Transmitting electrical power wirelessly is advantageous because it may avoid the need for a physical connector to be located on the module housing. This would simplify the design and manufacturing requirements for the module housing and may also improve the safety and ease of use of the module. Furthermore, a module comprising means for transmitting and/or receiving electrical power wirelessly would allow for such functionality to be added to an operatively connected aerosol provision device, without the adding to the size, weight or cost of the aerosol provision device.

In another example, the module may comprise one or more means for user interaction. Such means could consist of, for example, one or more buttons, dials, switches, knobs, etc., or a touchscreen. The means for user interaction may also include means for communicating information to the user, for example regarding the remaining charge in the internal power supply. Such means for user interaction could consist of one or more lights (including LEDs), buzzers, clickers, loudspeakers, haptic components, screens and/or other displays etc. The means for user interaction could enable the user to control the aerosol provision device in order to, for example, change a heating profile. As previously discussed, if the module comprises an internal power supply configured to supply the aerosol provision device with additional power, the means for user interaction could allow for the user to select an optional "boost mode" to increase the power and/or temperature of the heater located within the aerosol provision device. The means for user interaction could also allow for the user to lock or unlock the device, allowing for increased safety and security. In an example where the module comprises one or more means for user interaction, such as a button, the module could allow the user to require an activation code be entered into the means for user interaction, in order to activate the aerosol provision device. Alternatively, the module could be configured such that user identification requires the module to be operatively connected to the aerosol provision device. In these examples, the aerosol provision device would be configured such that the user defined identification requirement is retained after the module is detached from the aerosol provision device. This example has the advantage that unauthorized users are prevented from using the aerosol provision device. The module could also be configured to automatically identify an aerosol provision device when it is first connected to the module.

In another example, the module may contain means for wireless communication with an external device. Examples of possible wireless communication protocols could be Bluetooth™, Wi-Fi™ cellular network communication etc. Wireless communication with an external device could allow for data transfer between the module and the external device. Such data could, for example, comprise usage data to be backed up, reviewed and/or analyzed using an external device. The data transfer may also allow for the module to be configured according to the preferences of the user by means of the external device. An external device may be, for example, a mobile phone, a tablet, a computer, etc.

In another example, the module may contain means for wireless transmission of electrical power. This may comprise means for receiving electrical power from an external supply, such as from an external wireless charging pad. Alternatively, or in addition, the means for wireless power transmission may be configured to transmit electrical power to a further device, external to the housing of the module. The further device may be another module, an aerosol provision device or an external device configured to receive electrical power wirelessly. The module may comprise more than one means for wireless transmission of electrical power, such that the module may transfer electrical power to or from more than one device simultaneously. Transmitting electrical power wirelessly is advantageous because it may avoid the need for a physical connector to be located on the module housing. This would simplify the design and manufacturing requirements for the module housing and may also improve the safety and ease of use of the module.

In any of the previously described examples, the module may further contain means for physically connecting it to an external device. The physical connection may allow for electrical power to be supplied to the module from an external device. The external device may be, for example, a plug connected to a wall socket or a back-up power supply, such as a battery or another energy storage device. This could allow for a user to interact with the module without it being operatively connected to an aerosol provision device, for example, to adjust pre-set user preferences, or to review information regarding previous usage of the aerosol provision device.

When the module is physically connected to an external device, and the external device is providing the module with electrical power, the supplied external power may be directed to charge at least one of: a power supply located within the module, i.e. an internal power supply; a power supply located within a further operatively connected module; and a power supply located within an operatively connected aerosol provision device, by means of a controller. The module may be configured such that the controller is capable of determining the amount of power being supplied to the module. The module may be further configured such that if the controller determines that the power supplied is insufficient to charge one or more of: the internal power supply of the module; the power supply of the operatively connected module; and the power supply located within the operatively connected aerosol provision device, the controller may preferentially direct the supplied power accordingly. The order in which the one or more power supplies should preferentially be charged may be pre-set or may be configurable by the user. It may be preferable for the power supply of an operatively connected aerosol provision device to be charged before any other power supplies, for example. The module may be further configured such that if the externally supplied power is insufficient to charge the internal power supply of the module, or any of the power supplies to which the module is operatively connected, the electrical power is not supplied to any of the power supplies. The module may also be configured to alert the user that the externally provided power supply is insufficient to charge one or more of the power supplies; the alert may be an audible, visual and/or tactile indication. The module may be additionally configured such that when an external power supply is connected, the module indicates to the user which, if any, of the operatively connected power supplies is being charged.

In a further example in which the module comprises means for physically connecting it to an external device, the connection may be configured such that data transfer can take place. Such a connection may comprise, for example, a standard data connector such as USB Type C connector. The data connection may allow for data to be exchanged with the external device. Such data could comprise, for example, usage information to be backed up, reviewed and/or analyzed using an external device. The data transfer may also allow for the module to be configured according to the preferences of the user using the external device. An external device may be, for example, a mobile phone, a tablet, a computer, etc.

In a further example, the module further comprises internal computer memory. The internal computer memory is located within the housing of the module, and can be non-volatile memory, such that data stored in the internal computer memory is retained in the event of electrical power loss. The internal computer memory may be configured to store user preferences. Such a module could allow for user preferences, or other data such as usage data of an operatively attached aerosol prevision device to be retained in the module.

In a further example of a module containing internal computer memory, the module is configured to capture data from an operatively connected aerosol provision device, and to store said preferences in the internal computer memory of the module. Alternatively, or additionally, the module is configured to copy user preferences stored in the internal computer memory of the module to an operatively connected aerosol provision device. Such a module has the advantage of allowing user preferences to be easily transferred from, or to, an operatively connected aerosol provision device. This could allow a user, for example, to implement previously set user preferences from an aerosol provision device, and to quickly and easily apply these user preferences to a new aerosol provision device. This could also allow a user to periodically capture user preferences on the module, such that in the event of accidental loss or damage to the aerosol provision device, a replacement device may be quickly and easily configured to the user's preferences.

It will be appreciated that several of the examples discussed above could be combined with one another. For example, a module could include both user interaction and power supply functionality, or user interaction and communications functionality. Whilst the possible module capabilities have been set out separately in some cases, their combination is not precluded within a single module.

According to a second aspect of the present disclosure, there is provided an aerosol provision device. The device comprises: a housing; an aerosol generator located within the housing; a power supply located within the housing; and one or more connectors, each configured to interact with a module. When one or more modules is operatively connected to the aerosol provision device, the operatively connected one or more modules provides the aerosol provision device with additional functionality, in use.

According to a third aspect of the present disclosure, there is provided a system comprising an aerosol provision device and one or more modules, wherein the one or more modules is operatively connected to the aerosol provision device, the operative connection being either: a direct connection to the aerosol provision device; or a connection to one or more other modules, wherein at least one of the one or more other modules is directly connected to the aerosol provision device, the operatively connected one or more modules providing the aerosol provision device with additional functionality.

Referring to FIG. 1, a module 100 for use with an aerosol provision device is schematically illustrated. The module 100 comprises: a housing 102; a controller 108 located within the housing 102; a first connector 110 and a second connector 112, each connector being configured to interact with either an aerosol provision device or another module.

The housing 102 of the module 100 may be composed from any suitable material. A metallic material such as steel or aluminum may be used; stainless steel and aluminum are inexpensive, easy to manufacture and offer good corrosion resistance. A housing comprising a metallic material may also offer improved dissipation of any heat generated within the device, increasing user comfort during use, and may be more aesthetically pleasing than alternative options. Electrically conductive materials may be used; a housing composed from an electrically conductive material may additionally function as an antenna to facilitate or improve wireless communication, in examples where the module comprises means for wireless communication, as described in more detail below. Alternatively, the housing may be made from plastic. Plastic is inexpensive, it can be easily formed into any desired shape and is not electrically conductive, which may help to improve the safety of the device. Examples of suitable plastic materials could be polycarbonate (PC), acrylonitrile butadiene styrene (ABS) or a combination of PC and ABS; PC and ABS are strong, tough, inexpensive and can be easily formed into any required shape. PC and ABS can also both be easily colored and decorated both within the structure of the plastic material and with surface paints; this allows for the housing 102 to be easily decorated. Furthermore, a plastic material may beneficially allow for a discrete antenna to be embedded with the plastic material of the housing or printed onto the outer and/or inner surface of the housing 102 in order to facilitate or improve wireless communication, in examples where the module comprises means for wireless communication, as described in more detail below. The housing 102 may be configured to be changeable, allowing for the housing 102 to be replaced by the user, for example to change its appearance.

The module 100 comprises at least one connector 110, the connector 110 being configured to connect to the connector of another module or an aerosol provision device. When connected to the connector of another device, the connector 110 of the module and the connector of the other device may be referred to as 'a pair of connectors'.

In some examples, the first connector 110 and any further connectors are configured in such a way that an operative connection is formed with another module or with an aerosol provision device without physical engagement of the pair of connectors. If the housing 102 does not have any openings, it could be water resistant in that the housing material is resistant to water and the lack of openings in the housing prevents water ingress into the internal components of the module. A means for securing the module 100 to at least one second device (a second device being another module or an aerosol provision device) without physical engagement of the pair of connectors can additionally be provided. In one example, the module 100 comprises at least one magnet (or a portion of magnetic material) arranged such that when the second device also comprises at least one magnet, the at least one magnet of the module and the at least one magnet of the second device secure the devices relative to one another by magnetic attraction. In this example, the one or more magnets are positioned such that the magnetic attraction between the magnet(s) of the module 100 and the magnet(s) of the second device cause the module 100 and the second device to be aligned in a manner that allows for the pair of connectors to be operatively connected. This type of alignment is particularly useful where the operative connection between the pair of connectors is a wireless one and there is, therefore, no additional physical engagement of the components.

In some examples, the pair of connectors is configured to be physically engaged in order to be operatively connected. In these examples, the housing 102 of the module 100 comprises one or more openings to facilitate connection with other devices. In one example, the first connector 110 and the second connector 112 are each arranged adjacent to an opening in the housing 102, such that each of the connectors can physically engage with a connector of another device when it is placed inside, or at least adjacent to, the respective opening in the housing 102.

In examples where the pair of connectors are physically engaged to make an operative connection, at least one of the connectors may comprise a 'male' portion, configured to be inserted into the 'female' portion of the corresponding connector. It is also possible that each connector comprises both a male and a female portion, such that any connector may be connected to any other connector. However, it is preferable that the connectors comprise only male or female portions, such that, in use, the number of male connector portions not connected to a female connector (i.e. non-connected male connectors) is minimized. The male portion of a connector must, by definition, extend outwards. Therefore, when the module is in use, a non-connected male connector is more likely to be accidentally damaged than a non-connected female connector. Furthermore, when a module is in use, a non-connected male connector could possibly cause damage to external objects, or discomfort to the user.

In one example, the first connector 110 of a module 100 is the only male connector of the module 100. The module 100 may comprise one or more additional female connectors, into which the male portion of a connector of another module or an aerosol provision device may be inserted. In some examples, the module is prevented from operating unless the first connector 110 is connected to another device (either another module or an aerosol provision device). Therefore, if the first connector 110 of the module 100 is connected to another device, it may be understood that, in use, a system comprising one or more such modules 100, operatively connected to an aerosol provision device, will have no modules comprising a non-connected male connector.

In one example, the module 100 comprises only a first connector 110, and no further connectors. A module according to this example may be connected to only one of: another module; or an aerosol provision device. A module 100 comprising only a first connector 110 may be preferable in order to simplify the design and manufacturing of the module. In some examples, the first connector 110 is a male type connector.

In another example, the housing 102 of the module 100 may be configured such that when the module 100 is connected to a second device, the housing 102 secures the module 100 to the second device by an interference fit. Such an arrangement could be achieved, for example, by configuring the housing 102 of the module 100 such that the housing 102 is configured to at least partially surround or enclose the second device, or vice versa. Other types of physical engagements between the module 100 and the second device are also possible, for example a screw or bayonet type connection, whereby a portion of the module housing 102 comprises a screw or bayonet type fitting to be inserted into a corresponding connector on the second device and twisted or turned in order to form a secure engagement (or vice versa). The housing 102 could also comprise one or more movable engagement members, such as a latch or a spring-loaded button, or means to engage with such a moveable member on the second device, in order to improve the security of engagement with the second device. Physical engagement of this kind has the benefit that the user will have a tactile indication as to the security of the engagement.

The module 100 may comprise means for connecting to an external device (other than an aerosol provision device or another module), herein referred to as an 'external connector' (not shown in the figures). An external connector configured to form a physical connection with an external device may be a commercially available connector such as a USB Type-C, or a proprietary connector. An external connector may alternatively be a wireless external connector, configured to connect wirelessly to an external device. A wireless external connector may use, for example, Bluetooth™, Wi-Fi™, NFC or a cellular network connection. The external connector may allow for the module 100 to receive electrical power from an external device. The external connector may additionally or alternatively allow for the exchange of data between the module 100 and the external device. Such data may, for example, comprise information regarding the use of the module. In embodiments where articles comprising aerosol-generating material are consumed, such module usage data may, for example, allow for additional consumable articles to be automatically ordered when required.

The module 100 illustrated in FIG. 1 comprises a controller 108, which may be configured to determine if the connector 110 is operatively connected to a second device. The controller 108 may also be configured to identify the second device when it has been detected that the connector 110 is operatively connected to a second device. The controller 108 may additionally be configured to communicate with an operatively connected device. For example, the controller 108 may be configured to report to an operatively connected device with information about the module 100. The controller 108 may alternatively or additionally be configured to receive information from an operatively connected second device. Information reported to the operatively connected device may comprise, for example, the charge level of the power supply 106 of the module 100. In another example, similar information may be reported to the module 100 from an operatively connected second device. In examples where the module 100 comprises a second connector 112 (and optionally further connectors), the controller may be configured to communicate with more than one directly connected device simultaneously.

Figure 2:
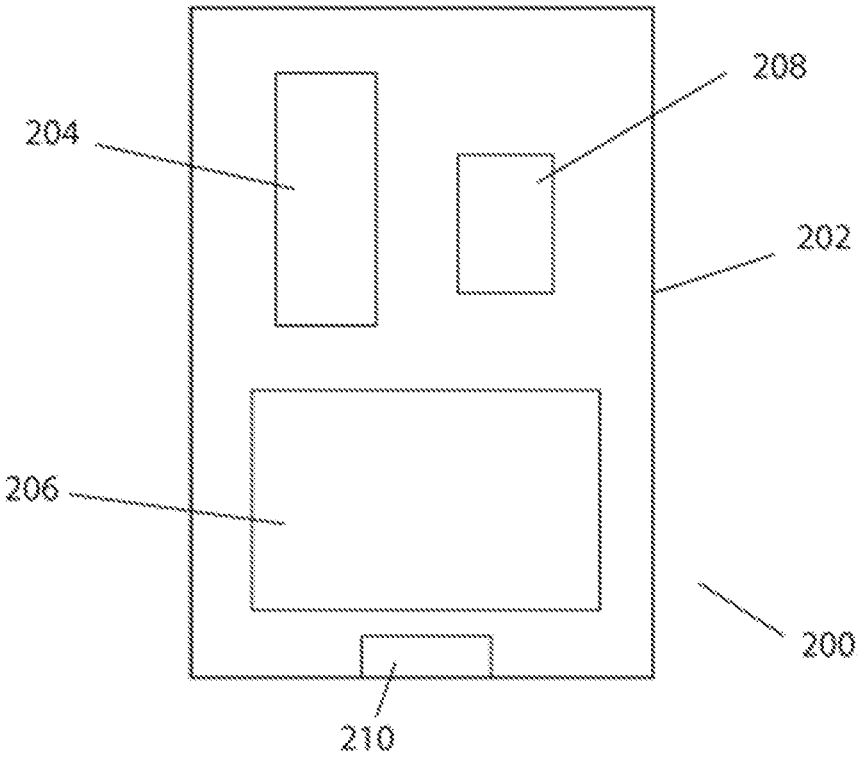
FIG. 2 shows a schematic view of an example of an aerosol provision device.

Referring to FIG. 2, an aerosol provision device 200 is schematically illustrated. The aerosol provision device 200 comprises: a housing 202 (which may also be referred to as the 'outer cover'); an aerosol generator in the form of a heater 204 located within the housing 202; a power supply 206 located within the housing 202 and connected to the heater via a controller 208; and a connector 210 configured to interact with a module. An aerosol provision device 200 according to the present disclosure is configured to function independently when not connected to any additional modules. An aerosol provision device 200 according to the present disclosure may comprise a puff sensor (not shown in the figures), configured to detect when a user is drawing on the aerosol provision device 200. The aerosol provision device 200 may be configured such that when the puff sensor detects the user is drawing on the device 200, the heater 204 is activated. The puff sensor and the heater 204 may each be connected to the controller 208 such that activation of the heater 204 is controlled by the controller 208. The controller 208 may be configured to deactivate the heater 204 after a predetermined period of time. The controller 208 may also be configured to deactivate the heater 204 when the puff sensor detects that the user is no longer drawing on the device 200 or when a certain number of puffs have been taken. The controller 208 may be connected to the power supply 206 and may be configured to determine the amount of charge remaining in the power supply 206. The controller may be configured to prevent activation of the heater 204 is insufficient charge is remaining in the power supply 206. The amount of charge in the power supply 206 considered to be sufficient in order for the controller 208 to activate the heater 204 may be such that the heater 204 is able to complete a predetermined session.

In some examples, the first connector 210 and any further connectors are configured in such a way that an operative connection is formed with a module without physical engagement of the pair of connectors. In such an aerosol provision device 200, means for securing the aerosol provision device 200 to at least one module without physical engagement of the pair of connectors can additionally be provided. In one example, the aerosol provision device 200 comprises at least one magnet (or a portion of magnetic material) arranged such that when a module comprises at least one magnet, the at least one magnet of the aerosol provision device 200 and the at least one magnet of the module secure the devices relative to one another by magnetic attraction. In this example, the one or more magnets are positioned such that the magnetic attraction between the magnet(s) of the aerosol provision device 200 and the magnet(s) of the module cause the aerosol provision device 200 and the module to be aligned in a manner that allows for the pair of connectors to be operatively connected. This type of alignment is particularly useful where the operative connection between the pair of connectors is a wireless one and there is, therefore, no additional physical engagement of the components.

Figure 3:
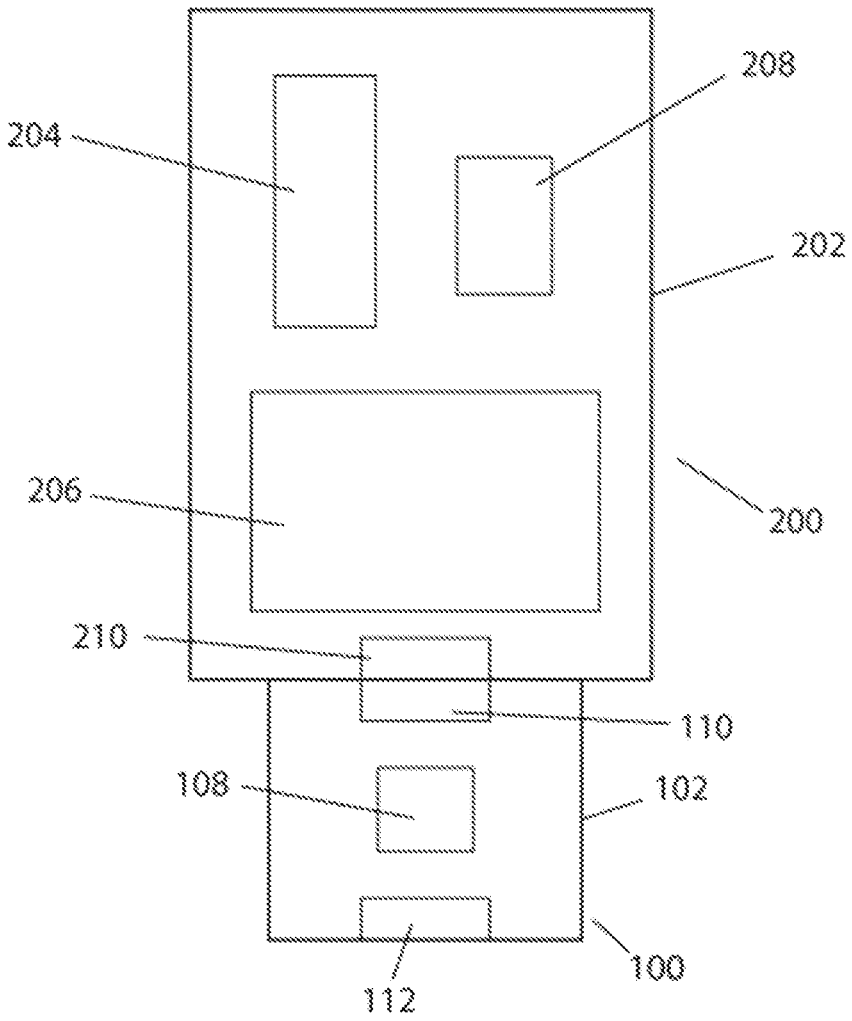
FIG. 3 shows a schematic view of an example of a module and an aerosol provision device demonstrating one possible example of how a module and an aerosol provision device could be operatively connected.

Referring to FIG. 3, a system comprising an aerosol provision device 200 and a module 100 is schematically illustrated. The connector 210 of the aerosol provision device 200 is directly connected to the first connector 110 the module. In such a system, the module 100 may comprise a second connector 112 to which an additional module may be connected.

Figure 4:
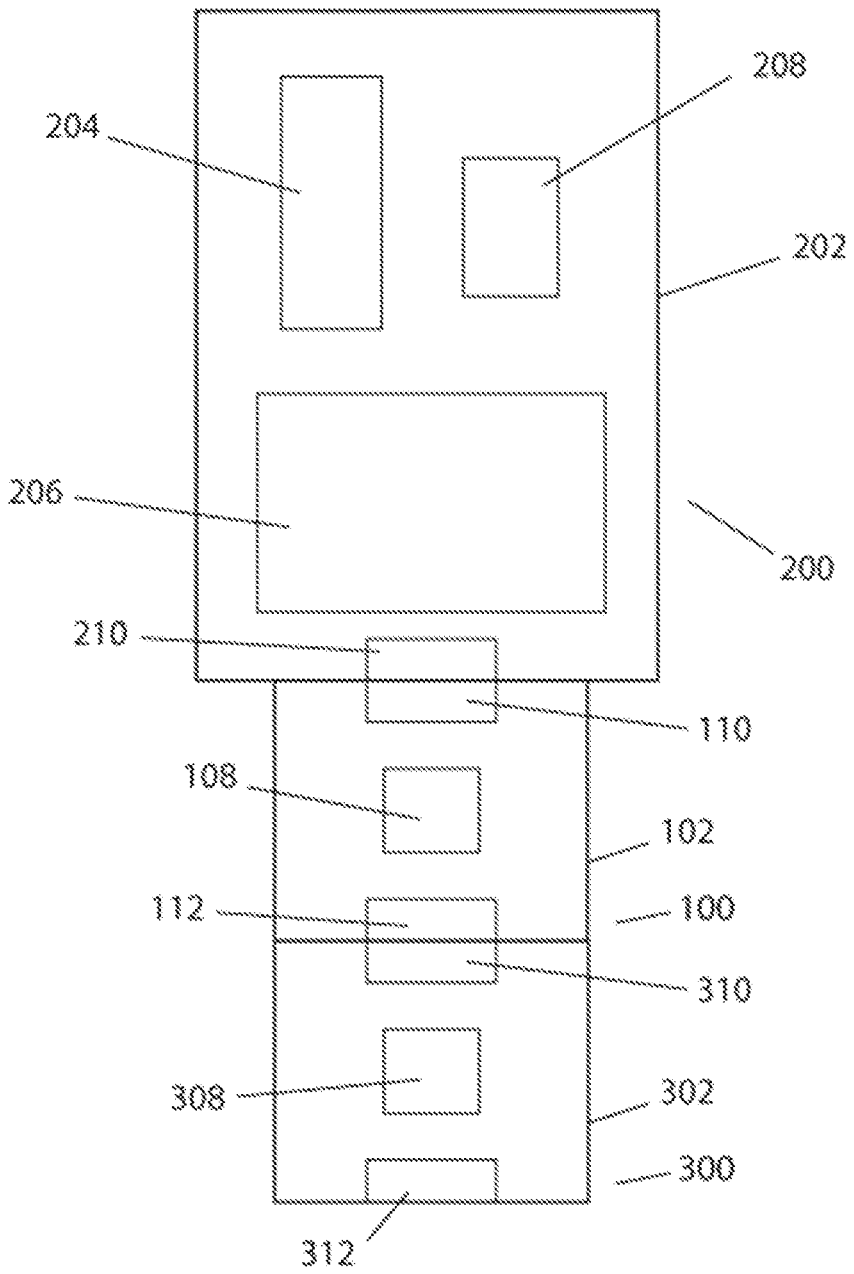
FIG. 4 shows a schematic view of an example of two modules and an aerosol provision device demonstrating one possible way in which they could be operatively connected.

Referring to FIG. 4, a system comprising the aerosol provision device 200, the module 100 and a second module 300 is schematically illustrated. The first connector 210 of the aerosol provision device 200 is directly connected to the first connector 110 the module 100, whereas the first connector 310 of the second module 300 is directly connected to the second connector 112 of the first module 100, such that the aerosol provision device, the module 100 and the module 300 are connected in series. In this system, the first module and the second module are both operatively connected to the aerosol provision device, such that, in use, both the first module and the second module provide the aerosol provision device with additional functionality.

As illustrated in FIG. 4, in use, the first connector 110 of a first module 100 may be connected to an aerosol provision device 200, while the second connector 112 is connected to the first connector 310 of a second module 300. In such an arrangement, the controller 108 of the first module 100 may be configured to communicate with the aerosol provision device 200 and the second module 300 simultaneously. The controller 308 of the second module 300 may also be configured to communicate with the directly connected module 100 and the operatively aerosol provision device 200. In examples where an aerosol provision device 200 is operatively connected to more than one module, it may be preferable for the controller 108 of the first module 100 (the first module 100 being directly connected to the aerosol provision device 200) to be configured to have 'communicative authority' over the system. Communicative authority may mean that the controller 108 of the first module 100 is configured to have overall control over the functionality of the operatively connected system. For example, when in communicative control, the controller 108 of the first module 100 may be configured to determine how to distribute electrical power to the operatively connected system from a power supply contained within one of the operatively connected modules. In one example, this power supply may or may not be contained within the first module 100. In some embodiments, a module may be specially configured such that it is able to control other modules; in such an embodiment this module may be required to be the 'first module' in an operatively connected system comprising more than one operatively connected module, and thus must be directly connected to the aerosol provision device 200. In other embodiments, all modules may be configured such that if they are directly connected to the aerosol provision device 200, they are able to act as the 'first module' and thus have communicative authority over an operatively connected system comprising more than one operatively connected module.

Figure 5:
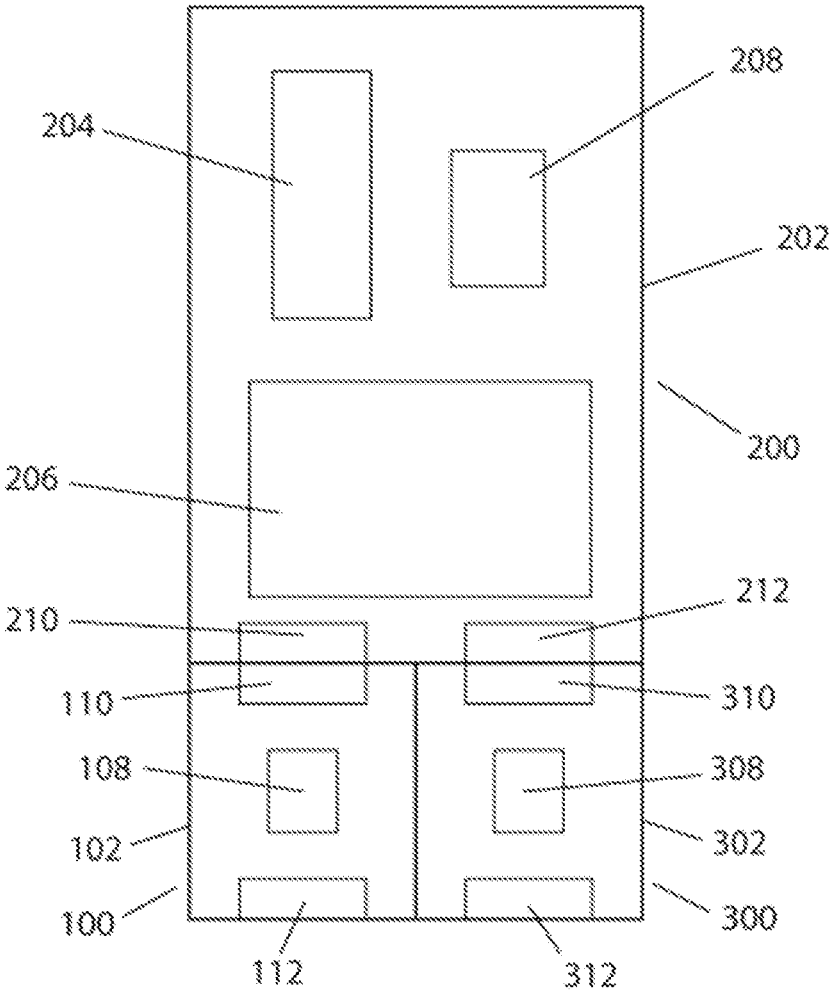
FIG. 5 shows a schematic view of an example of two modules and an aerosol provision device demonstrating a further possible way in which they could be operatively connected.

Referring to FIG. 5, another system comprising the aerosol provision device 200, the module 100 and the second module 300 is illustrated. In this example, the aerosol provision device comprises a first connector 210 and a second connector 212. The first connector 110 of the module 100 is directly connected to the first connector 210 of the aerosol provision device 200. The first connector 310 of the second module 300 is also directly connected to the second connector 212 of the aerosol provision device 200, so that the module 100 and the second module 300 are arranged in parallel with one another at one end of the aerosol provision device 200. In this system, the module 100 and the second module 300 are each also operatively connected to the aerosol provision device, such that, in use, both the first module and the second module provide the aerosol provision device with additional functionality.

Figure 6:
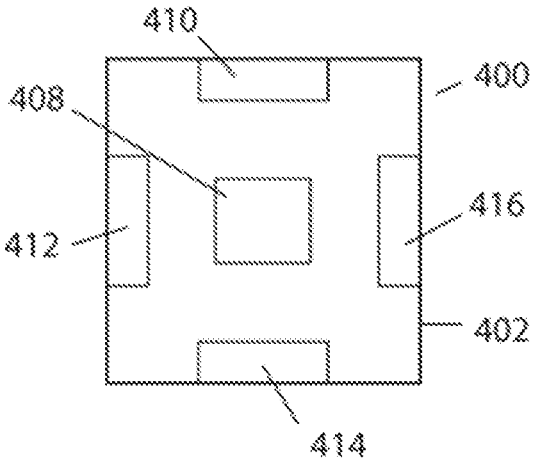
FIG. 6 shows a schematic view of an example of a hub-type module.

Referring to FIG. 6, a module 400 comprises a first connector 410, and three additional connectors 412, 414, 416. In one example, the connectors are all configured to physically engage with connectors of other modules or of an aerosol provision device. The first connector 410 may be of a male type, and all of the additional connectors may be of a female type. In an example where the first connector 410 is a male type connector, and the module further comprises at least two additional connectors where each of the additional connectors is a female type connector, the module may be referred to as a 'hub-type' module.

In an example in accordance with FIG. 6, the first connector 410 is a male type connector and the remaining connectors 412, 414, 416 are all female type connectors. In this example, the first connector 410 is able to connect to a female type connector of another module or an aerosol provision device. The module 400 is also able to connect to the male type connector of up to three further devices using the additional connectors 412, 414, 416. In one example, a hub-type module 400 of this type could be used with an aerosol provision device comprising only a single female connector. In this arrangement, the first connector 410 of the hub-type module 400 is connected to the first connector of the aerosol provision device. Up to three additional modules may then be connected to the hub-type module 400, each to one of the additional connectors 412, 414, 416.

Such an arrangement would allow for multiple modules to be operatively connected to an aerosol provision device, even if the aerosol provision device comprises only a single connector. A hub-type connector 400 can comprise at least three connectors; a first connector 410 and two or more additional connectors. In some examples, the first connector 410 is a male type connector and the two or more additional connectors are female type connectors. In some examples, the controller 408 of the hub-type module 400 is configured to communicate with other operatively connected modules. In some examples, the controller 408 is configured to direct the function of other operatively connected modules, i.e. the controller 408 directly controls the function of other operatively connected modules.

Figure 7:
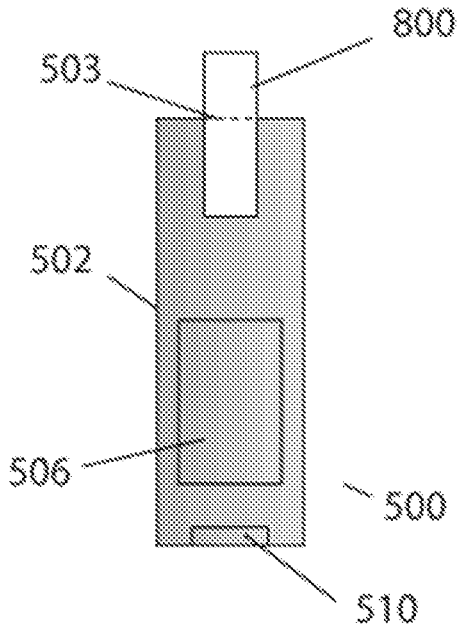
FIG. 7 shows a schematic view of an example of an aerosol provision device.

FIG. 7 illustrates a further example of an aerosol provision device 500, comprising a housing 502, a power supply 506 and a first connector 510, the housing comprising an opening 503 into which an article comprising aerosol-generating material 800 may be inserted. The aerosol provision device 500 also comprises an aerosol generator in the form of a heater; however, this is not shown in the illustration.

Figure 8:
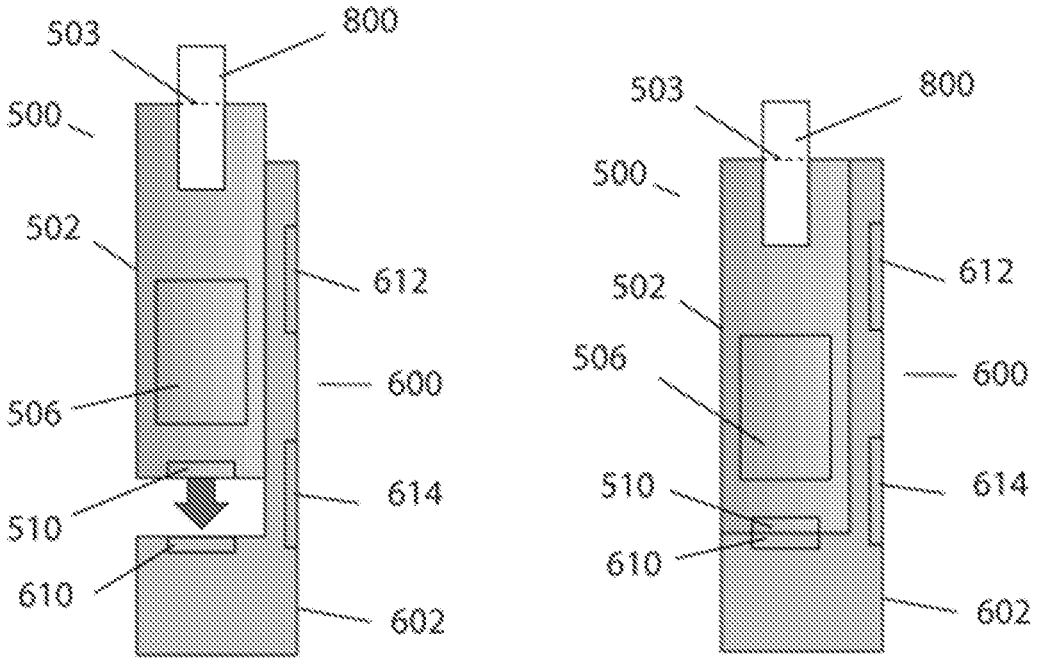
FIG. 8 shows schematic views of the aerosol provision device of FIG. 7 and an example L-shaped module, indicating how they could be operatively connected.

FIG. 8 illustrates another example of a system comprising an aerosol provision device 500 and a module 600. The module 600 comprises a first connector 610 configured to connect to the first connector 510 of the aerosol provision device. In this example, the module 600 is configured such that when an operative connection is made between the first connector 510 of the aerosol provision device 500 and the first connector 610 of the module 600, the module 600 partially surrounds the aerosol provision device 500. Such an arrangement improves the strength and durability of the connection between the aerosol provision device 500 and the module 600, and provides a robust system overall. Such an arrangement may reduce the likelihood of the operative connection being accidentally broken during use, for example. Such an arrangement may also, in use, be more ergonomic than other arrangements, allowing for increased user comfort. As illustrated in FIG. 8, the aerosol provision device 500 and the module 600 are configured such that the aerosol provision device 500 may be slid into place in order to operatively connect to the module 600. In such an arrangement, the module 600 and aerosol provision device 500 assists in properly aligning the two connectors; for example the housing 602 of the module 600 may comprise a guiding groove into which a protrusion located on the housing 502 of the module 500 may be slid in order to properly align the first connector 510 of the aerosol provision device 500 and the first connector 610 of the module 600.

In the example illustrated in FIG. 8, the module 600 comprises a second connector 612 and a third connector 614 arranged on the side of the module 600 and configured to operatively connect to additional modules. It is understood that a module 600 according to this example may comprise further connectors, and any of the second or further connectors may be disposed anywhere on the module 600.

Figure 9:
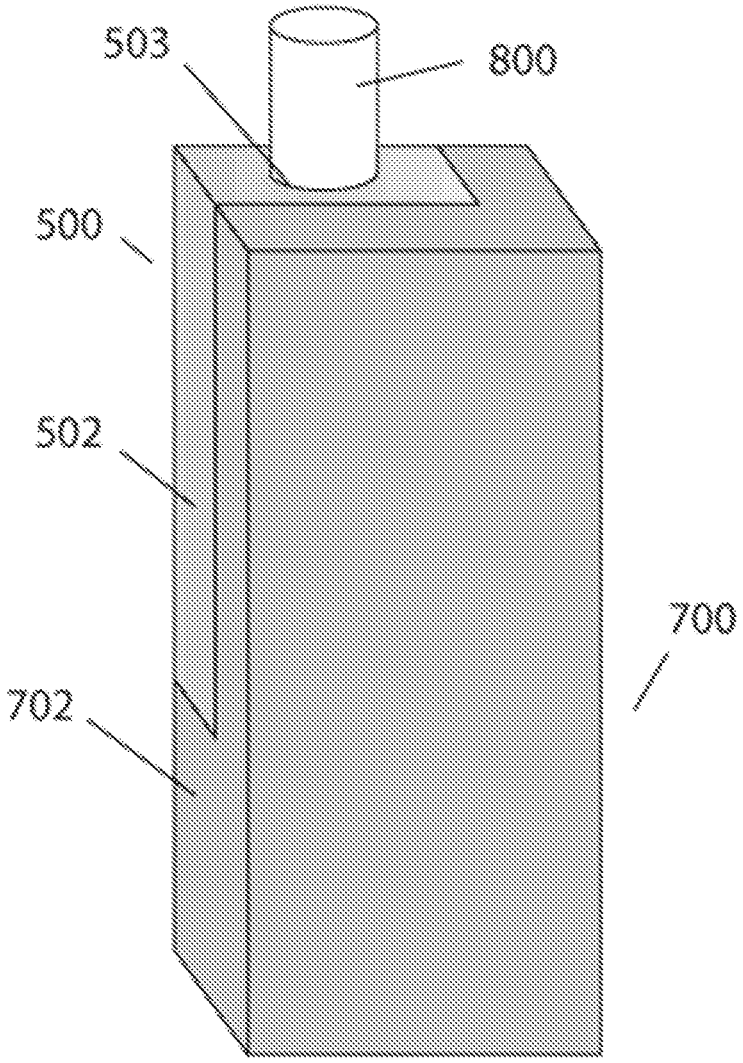
FIG. 9 shows a schematic view of an example system comprising an aerosol-generation device and a module operatively connected thereto.
Figure 10:
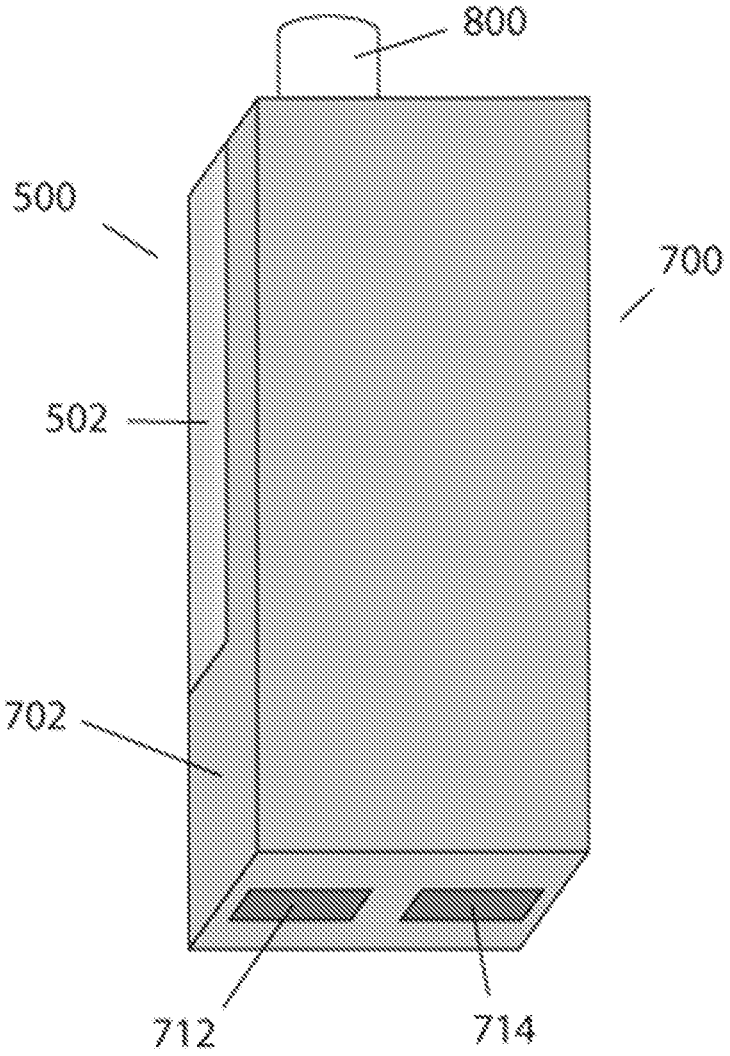
FIG. 10 shows a schematic view of the system of FIG. 9, also showing a base of the module.

FIGS. 9 and 10 illustrate another example where the aerosol provision device 500 is connected to a module 700. As with the example illustrated in FIG. 7, in these illustrated examples, the module 700 is configured such that it partially surrounds the aerosol provision device 500. The first connector of the module 700 is not shown in the illustrations; however, as with FIG. 7 it is configured to operatively connect with the first connector (also not shown) of the aerosol provision device 500. In FIG. 10, a second connector 712 and a third connector 714 are shown to be located on the bottom of the module 700. As with the example of FIG. 8, there may be a fewer or greater number of additional connectors. As in FIG. 8, the aerosol provision device 500 and the module 700 may comprise a guiding groove and a corresponding protrusion configured to assist in correctly aligning the pair of connectors when connecting the aerosol provision device 500 and the module 700.

The above embodiments are to be understood as illustrative examples of the disclosure. Further embodiments of the disclosure are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A module for use with an aerosol provision device, the module comprising:

a housing; and one or more connectors configured to interact with an aerosol provision device or another module;

wherein the module is a discrete unit separate from and removably connectable to the aerosol provision device;

wherein, in use, the module is configured to be operatively connected by the one or more connectors to the aerosol provision device, either directly or via one or more further modules;

wherein the module further comprises one or more components configured to provide the operatively connected aerosol provision device with additional functionality, in use;

wherein the module is configured to supply additional power to the operatively connected aerosol provision device, and wherein, in use, the module allows the aerosol provision device to operate in a higher power mode.

2. The module according to claim 1, further comprising one or more controllers, each of the one or more controllers being configured to control at least one aspect of functionality of the module.

3. The module according to claim 1, wherein the one or more components comprises an internal power supply.

4. The module according to claim 3, wherein the internal power supply comprises a rechargeable battery or a capacitor.

5. The module according to claim 1, wherein the one or more components comprises one or more means for user interaction.

6. The module according to claim 1, wherein the one or more components comprises means for wireless communication with an external device.

7. The module according to claim 6, wherein the means for wireless communication uses one or more of the following wireless communication protocols: short range wireless communication protocols; or cellular network communication.

8. The module according to any of claim 1, wherein the one or more components comprises means for wireless transfer of electrical power.

9. The module according to claim 1, wherein the one or more components comprises a connection for physically connecting with an external device.

10. The module according to claim 9, wherein the connection allows for external power to be supplied to the module.

11. The module according to claim 10, wherein when the module is physically connected to an external device, the supplied external power is directed to charge at least one of: a power supply located within the module; a power supply located within a further operatively connected module; or a power supply located within the operatively connected aerosol provision device.

12. The module according to claim 9, wherein the connection comprises a data connection configured to allow the module to exchange information with the external device.

13. The module according to claim 1, wherein the one or more components comprises internal computer memory.

14. The module according to claim 13, wherein the module is configured to store user preferences in the internal computer memory.

15. The module according to claim 13, wherein the module is configured to do at least one of: capture data from the operatively connected aerosol provision device, or apply user preferences to the operatively connected aerosol provision device.

16. The module according to claim 1, wherein the one or more components comprises means for allowing a user to configure the operatively connected aerosol provision device such that user identification is required before activation of the operatively connected aerosol provision device.

17. An aerosol provision device comprising:

a housing;

an aerosol generator located within the housing;

a power supply located within the housing; and one or more connectors, each of the one or more connectors configured to interact with one or more modules according to claim 1;

wherein when one or more modules is operatively connected to the aerosol provision device, the operatively connected one or more modules provides the aerosol provision device with additional functionality, in use.

18. A system comprising:

an aerosol provision device; and one or more modules according to claim 1, wherein the one or more modules is operatively connected to the aerosol provision device, the operative connection being either:

a direct connection to the aerosol provision device, or a connection to one or more other modules, wherein at least one of the one or more other modules is directly connected to the aerosol provision device, wherein the operatively connected one or more modules provides the aerosol provision device with additional functionality.

* * * * *